US008960234B2

(12) United States Patent
Cadeau et al.

(10) Patent No.: US 8,960,234 B2
(45) Date of Patent: Feb. 24, 2015

(54) GAS VALVE UNIT FOR A DUAL CIRCUIT BURNER

(75) Inventors: Christophe Cadeau, Strasbourg (FR); Jörn Naumann, Durbach (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 230 days.

(21) Appl. No.: 13/697,054

(22) PCT Filed: May 10, 2011

(86) PCT No.: PCT/EP2011/057479

§ 371 (c)(1),
(2), (4) Date: Nov. 9, 2012

(87) PCT Pub. No.: WO2011/144491

PCT Pub. Date: Nov. 24, 2011

(65) Prior Publication Data

US 2013/0056663 A1 Mar. 7, 2013

(30) Foreign Application Priority Data

May 20, 2010 (EP) ..... 10290272

(51) Int. Cl.

| | |
|---|---|
| ***F16K 11/14*** | (2006.01) |
| ***F17D 3/00*** | (2006.01) |
| ***F16K 31/08*** | (2006.01) |
| ***F23D 14/06*** | (2006.01) |
| ***F24C 3/12*** | (2006.01) |
| ***F23N 1/00*** | (2006.01) |
| ***F23K 5/00*** | (2006.01) |

(52) U.S. Cl.

CPC ..... *F23N 1/007* (2013.01); *F23K 5/007* (2013.01); *F23D 2900/14062* (2013.01); *F23N 2035/18* (2013.01); *F23N 2035/22* (2013.01); *F23N 2037/10* (2013.01); *F23N 2041/08* (2013.01)

USPC ..... 137/862; 137/599.05; 251/65; 126/39 R; 431/278

(58) Field of Classification Search

USPC ..... 137/862, 637, 883, 599.05; 251/65; 431/278, 284, 354; 126/1 R, 24, 39 R, 126/39 E, 39 H, 39 J, 39 K, 214 A, 39 N

See application file for complete search history.

(56) References Cited

U.S. PATENT DOCUMENTS 4,170,245 A * 10/1979 Haley ..... 137/487.5
5,938,425 A 8/1999 Damrath et al.

(Continued)

FOREIGN PATENT DOCUMENTS

DE 10249938 A1 5/2004
EP 2312212 A2 4/2011

(Continued)

OTHER PUBLICATIONS

International Search Report PCT/EP2011/057479 dated Feb. 4, 2013.

*Primary Examiner* — John K Fristoe, Jr.
*Assistant Examiner* — Michael R Reid
(74) *Attorney, Agent, or Firm* — James E. Howard; Andre Pallapies

(57) ABSTRACT

A gas valve unit for adjusting a gas volume flow in a dual circuit gas burner of a gas appliance includes a valve body having a gas inlet and two gas outlets; and a control mechanism constructed to adjust the gas volumetric flow supplied to one of the gas outlets in a number of stages and to adjust the gas volumetric flow supplied to other one of the gas outlets in a number of stages.

20 Claims, 7 Drawing Sheets

(56) References Cited

U.S. PATENT DOCUMENTS

| | | | | |
|---|---|---|---|---|
| 6,609,904 | B2 * | 8/2003 | Chen | 431/71 |
| 7,291,009 | B2 * | 11/2007 | Kamal et al. | 431/284 |
| 8,667,988 | B2 * | 3/2014 | Cadeau et al. | 137/636 |
| 8,757,203 | B2 * | 6/2014 | Cadeau et al. | 137/599.03 |

FOREIGN PATENT DOCUMENTS

| | | | |
|---|---|---|---|
| WO | 2008141916 | A2 | 11/2008 |
| WO | 2009010400 | A1 | 1/2009 |

* cited by examiner

GAS VALVE UNIT FOR A DUAL CIRCUIT BURNER

BACKGROUND OF THE INVENTION

The invention relates to a gas valve unit for adjusting gas volume flows to a dual circuit gas burner of a gas appliance, in particular gas cooking appliance, wherein the gas valve unit comprises a gas inlet and two gas outlets.

Gas burners having two concentrically-disposed rings with a gas outlet openings are frequently used in gas cooking appliances. During the operation of the gas hob, a flame ring can burn at each of the rings with gas outlet openings. When the gas volume flows to the two rings with gas outlet openings are able to be adjusted separately, these gas burners are referred to as dual circuit gas burners. By comparison with conventional gas burners with only one flame ring, dual circuit gas burners generally possess a greater maximum burner power. In addition dual circuit gas burners possess an especially large spread between minimum burner power and maximum burner power. At maximum burner power both flame rings burn with the largest possible flames. At minimum burner power only the smaller flame ring burns with the smallest possible flames, while no gas flows out of the larger ring with flame outlet openings.

Gas valves for supply of dual circuit gas valves possess a gas input with which the gas valve is connected to a main gas line of the gas cooking appliance. A first gas output of the gas valve opens out into a first part gas line leading to the smaller ring with gas outlet openings. A second gas outlet is connected to a second part gas line leading to the larger ring with gas outlet openings.

Dual circuit gas valves possess a single actuation element with which both the gas flow for supplying the first flame ring and also the gas flow for supplying the second flame ring can be adjusted. In accordance with a first possible design of the dual circuit gas valve, starting from a completely closed dual circuit gas valve, on actuation of the actuation element the gas flow is first opened to the smaller ring with gas outlet openings. Subsequently when the smaller flame ring has reached its maximum power, the gas flow to the larger ring with gas outlet openings is also opened, until the larger flame ring has also reached its maximum power. In accordance with a second possible design the completely closed position of the dual circuit gas valve is directly followed by the switch position for maximum power of both flame rings. A further actuation of the control element initially reduces the power of the larger flame ring, until this is extinguished completely. Subsequently the power of the smaller flame ring is reduced until this has reached its minimum power. In both the embodiments, depending on the position of the actuation element, either the dual circuit gas valve is completely closed or exclusively the gas flow to the smaller ring with gas outlet openings is opened or the gas flow to both rings with gas outlet openings is opened. On the other hand there is no provision for closing the gas flow to the smaller ring with gas outlet openings while the gas flow to the larger ring with gas outlet openings is opened.

Known gas valve units for dual circuit gas burners are generally designed as plug valves, in which a valve plug is rotated into a valve housing by means of the actuation element. With these known valves the exact setting of a desired burner power as well as the reproducibility of such a setting proves difficult.

BRIEF SUMMARY OF THE INVENTION

The underlying object of the present invention is to provide a generic gas valve unit in which this adjustability is improved.

This object is inventively achieved by the gas volume flow supplied to a first gas outlet being able to be adjusted in a number of stages and by the gas volume flow supplied to a second gas outlet likewise being able to be adjusted in a number of stages. The gas volume flow to each of the two gas outlets is able to be switched discretely in a number of stages. There is no intermediate stage adjustment provided. Each individual switching stage can be explicitly selected by an operator of the gas valve unit and is reproducible.

Preferably, for adjusting the gas volume flow supplied to the first gas outlet, the gas valve unit has at least two on-off valves and at least two first throttle points, preferably at least three first on-off valves and at least three first throttle points. The on-off valves and the throttle points are components of the gas valve unit. Each of the throttle points possesses a defined flow cross-section and is suitable for defining the size of a gas volume flow exactly and reproducibly. The throttle points through which gas flows and does not flow are determined by means of the on-off valves. The on-off valves are actuated directly or indirectly by the operator by means of an actuation element.

The same applies to the adjustment of the gas volume flow to the second gas outlet. For adjusting the gas volume flow supplied to the second gas outlet, the gas valve unit thus has at least two second on-off valves and at least two second throttle points, preferably at least four second on-off valves and at least four second throttle points. More on-off valves and more throttle points are preferably assigned to the second gas outlet than to the first gas outlet since the power range of the flame ring assigned to the second gas outlet is greater and a greater number of switching stages has proved to be sensible here.

Especially advantageously a magnetically acting body, preferably at least one permanent magnet, is provided for controlling the on-off valves, which is able to be moved relative to the on-off valves. The on-off valves are actuated there on account of the magnetically acting body preferably embodied as a permanent magnet. For example valve bodies of the on-off valves can consist of ferrite but not permanently-magnetizable material, on which a force of attraction is exerted with the movable permanent magnet. In this case only those valve bodies are attracted by the permanent magnet and thereby the on-off valves concerned opened which are in the immediate spatial vicinity of the permanent magnet. If the permanent magnet is moved away again from this on-off valve the on-off valve closes automatically. As an alternative it is possible to embody the valve body of the on-off valves from a permanent magnetic material while the movable magnetically acting body consists of ferrite but not permanently-magnetizable material. This enables the same mode of operation to be achieved.

A development of this arrangement makes provision for at least two magnetically acting bodies, preferably at least two permanent magnets, to be provided, wherein a first magnetically acting body is provided for controlling the first on-off valves and the second magnetically acting body is provided for controlling the second on-off valves. The position of the first magnetically acting body controls the gas volume flow to the first gas outlet, while the position of the second magnetically acting body controls the gas volume flow to the second gas outlet. It is possible to couple the movement of the two magnetically acting bodies to one another. The magnetically acting bodies can however also be moved independently of one another.

An advantageous development of the invention makes provision for a movement device, for displacing the at least one magnetically acting body preferably designed as a permanent magnet relative to the on-off valves such that, starting from a completely closed gas valve unit, by actuation of the movement device, first the on-off valves assigned to the first gas outlet will be actuated and then the on-off valves assigned to the second gas outlet will be actuated. This arrangement makes provision for the smaller flame ring to be ignited first when the gas burner is put into operation and subsequently, when the smaller flame ring has reached its maximum power, for the larger flame ring to be ignited. In this case a number of power stages are available both for the smaller flame ring and also for the larger flame ring. While the larger flame ring is burning the smaller flame ring continues to be operated at maximum power.

Preferably, depending on the position of the first magnetically acting body, either no first on-off valve or precisely one first on-off valve or precisely two first on-off valves are opened. Analogously, depending on the position of the second magnetically acting body, either no second on-off valve or precisely one second on-off valve or precisely two second on-off valves are opened. The on-off valves are opened continuously after one another in such cases. When the magnetically acting body is moved from one on-off valve to the next on-off valve, both on-off valves are opened during a switchover phase. When the movable magnetically acting body is disposed precisely in the area of one on-off valve, only this on-off valve is opened.

A possible embodiment of the invention makes provision for the movement device to be designed such that, in a switch position of the gas valve unit in which at least a first on-off valve is opened and all second on-off valves are closed, the second magnetically acting body is moved synchronously to the first magnetically acting body. In these switch positions no second on-off valve which could be opened by means of magnetic force is opposite the second magnetically acting body. Despite this the second magnetically acting body is moved along with the first magnetically acting body.

Furthermore the movement device is embodied such that, for a switching position of the gas valve unit in which at least one second on-off valve is opened, the first magnetically acting body is not moved as well for a movement of the second magnetically acting body. The movement path of the first magnetically acting body in this case is restricted by means of a stop for example. Thus, in this switch position, only the second magnetically acting body moves.

To this end the movement device is embodied such that, for a least one open second on-off valve, at least one first on-off valve, preferably precisely one first on-off valve is opened simultaneously. The first magnetically acting body in this case is held in a position by means of the said stop in which the first magnetically acting body opens a first on-off valve. As a rule it is that first on-off valve for which the gas volume flow to the first gas outlet is minimally large.

The gas valve unit comprises a first throttle path in which the first throttle points are disposed in a row and which each case has a connecting section between two adjacent first throttle points, which connecting section in each case connects a first on-off valve in the opened state to the gas inlet. The throttle points are located behind one another and are disposed in a row. Depending on which on-off valve is opened, the gas flow leads through one, two or more throttle points.

In a similar manner the gas valve unit comprises a second throttle path in which the second throttle points are disposed in a row and which in each case have a connecting section between two adjacent second throttle points which in each case connects a second on-off valve to the gas inlet in the opened state.

The throttle points of the first throttle path—viewed in the direction of gas flow in the first throttle path—have an increasing flow cross-section. In a similar manner the throttle points of the second throttle path—viewed in the direction of gas flow in the second throttle path—have an increasing flow cross-section. This means that primarily that throttle point which follows the opened on-off valve in the direction of gas flow, takes the gas volume flow to the relevant gas outlet. The throttle points following on in the throttle path have a larger flow cross-section and possess a comparatively smaller throttle effect on the gas volume flow.

BRIEF DESCRIPTION OF THE DRAWINGS

Further advantages and individual features of the invention are explained in greater detail with reference to the exemplary embodiment shown in the schematic figures, in which.

DETAILED DESCRIPTION OF EXEMPLARY EMBODIMENTS OF THE PRESENT INVENTION

Figure 1:
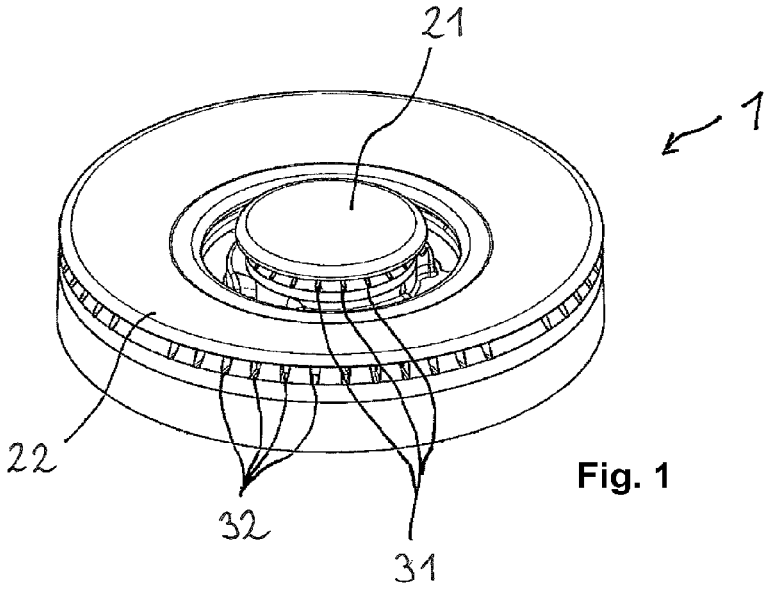
FIG. 1 shows a dual circuit gas burner.

FIG. 1 shows a dual circuit gas burner 1, as is normally used in gas cooking appliances. The dual circuit gas burner 1 comprises an inner burner 21 with first gas outlet openings 31 and an outer burner 22 with second gas outlet openings 32. The gas volume flows emerging through the first gas outlet openings 31 and the second gas outlet openings 32, and thereby the flame sizes of a first flame ring on the inner burner 21 and a second flame ring on the outer burner 22 can be adjusted separately from one another. For minimum power of the dual circuit gas burner 1 there are flames present exclusively at the inner burner 21. For maximum power of the dual circuit gas burner 1 there are flames present both at the inner burner 21 and also at the outer burner 22. The power of the dual circuit gas burner 1 can be increased in stages between the minimum power and the maximum power by, starting from the minimum power, the flame size at the inner burner 21 first being increased and subsequently the outer burner 22 being switched on, the flames of which are then increased in stages.

Figure 2:
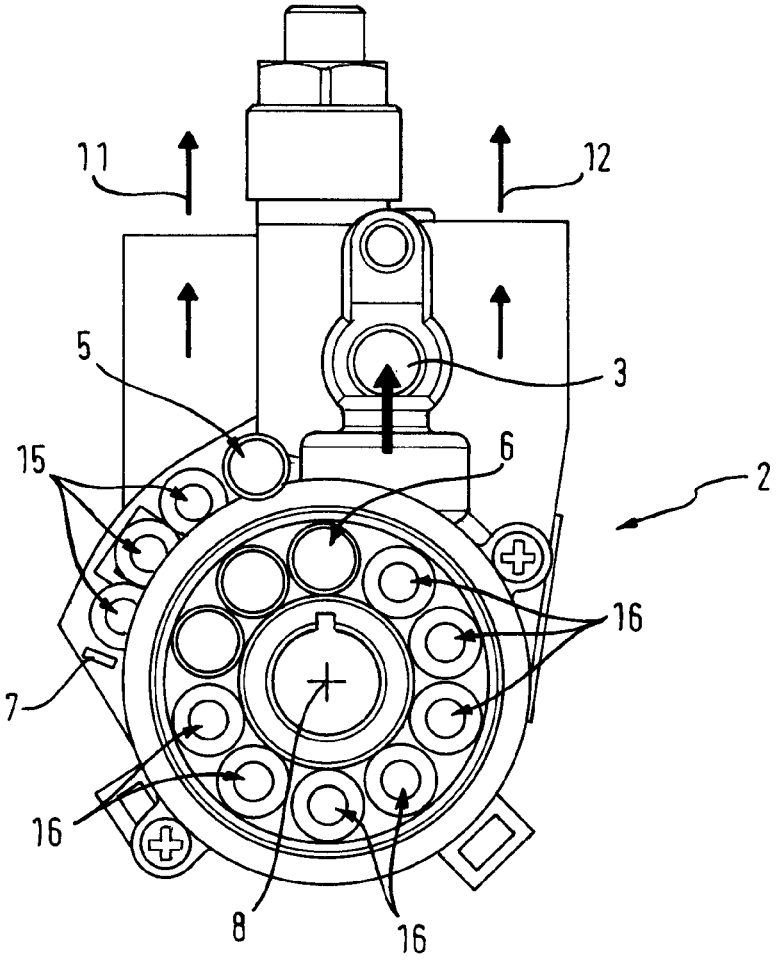
FIG. 2 shows an inventive gas valve unit as a dual circuit gas valve.

FIG. 2 shows an inventive gas valve unit embodied as a dual circuit gas valve 2 for supplying such a dual circuit gas burner 1. The dual circuit gas valve 2 possesses a single gas inlet 3, a first gas outlet 11 and a second gas outlet 12. The first gas outlet 11 is designed to be connected to the inner burner 21 of the dual circuit gas burner 1 while the second gas outlet 12 is designed to be connected to the outer burner 22 of the dual circuit gas burner 1. The gas flow to the first gas outlet 11 is controlled by first on-off valves 15, which are able to be actuated by means of a first magnetically acting body 5. In a similar manner the gas flow to the second gas outlet 12 is controlled by second on-off valves 16 which are able to be actuated by means of a second magnetically acting body 6.

In a preferred embodiment the magnetically acting bodies 5, 6 are each formed by a permanent magnet. The on-off valves 15, 16 each possess non-magnetizable ferromagnetic valve bodies on which the magnetically acting bodies 5, 6 formed by permanent magnets exert a force of attraction when they are positioned over the corresponding valve body. In an alternative embodiment it is possible to embody the valve bodies of the on-off valves 15, 16 as permanent magnets, while the movable magnetically acting bodies 5, 6 consist of non-magnetized ferromagnetic material.

The basic structure of an individual branch of the inventive gas valve, in particular the type of interaction of the magnetically acting bodies 5, 6 with the on-off valves 15, 16 and the guidance of gas inside the gas valve, corresponds to the layout of the subject matters of the European patent applications 09290589.2, 09290590.0 and 09290591.8, submitted on Jul. 27, 2009.

In the position shown in FIG. 2, the two magnetically acting bodies are located 5, 6 next to the on-off valves 15, 16, so that none of the on-off valves 15, 16 are opened. The dual circuit gas valve 2 is completely closed thereby. If the dual circuit gas valve 2 is actuated the magnetically acting bodies 5, 6 are moved in the counterclockwise direction around the axis 8. The movement of the magnetically acting bodies 5, 6 is initially synchronous in this case, until the first magnetically acting body 5 comes to rest at a stop 7. Subsequently only the second magnetically acting body 6 is moved around the axis 8, while the first magnetically acting body 5 remains at the stop 7. In the first part of the movement path of the magnetically acting bodies 5, 6 exclusively the first magnetically acting body is moved over on-off valves 15, while no on-off valves 15, 16 are yet to be located in the area of the second magnetically acting body 6. Only during the second part of the movement path, in which solely the second magnetically acting body 6 is moved, is this guided over the second on-off valves 16 which are then actuated after each other.

The switching within the dual circuit gas valve 2 in different switch positions is explained below with reference to the schematic FIGS. 3 to 7. The figures in each case show the first magnetically acting body 5, the second magnetically acting body 6, the first on-off valves 15 (15.1, 15.2, 15.3), the second on-off valves 16 (16.1 to 16.6), first throttle positions 17 (17.1, 17.2, 17.3) and second throttle positions 18 (18.1 to 18.6). If the at least one first on-off valve 15 is open, a first branch of the gas flow leads from the gas inlet 3 via this opened first on-off valve 15 and through at least one of the throttle points 17 to the first gas outlet 11. If at least one second on-off valve 16 is opened, a second branch of the gas flow leads from the gas inlet 3 via this opened second on-off valve 16 and through at least one of the second throttle points 18 to the second gas outlet 12. The first throttle points 17.1, 17.2 and 17.3 have three cross sections becoming larger in turn. The gas volume flow flowing to the first gas outlet 11 is definitively only defined by the first throttle point 17 located in the gas flow. If for example the on-off valve 15.1 is opened the throttle point 17.1 especially defines the size of the gas volume flow. If the on-off valve 15.2 is opened the throttle point 17.2 defines the gas volume flow, for an open on-off valve 15.3 the gas volume flow is defined by the throttle point 17.3. The last of the throttle points 17.3 can have such a large flow cross-section that practically no further throttling of the gas volume flow occurs. The switching and the mode of operation of the second on-off valves 16 in conjunction with the second throttle point 18, in the branch of the gas volume flow leading to the second gas outlet 12, is similar.

Figure 3:
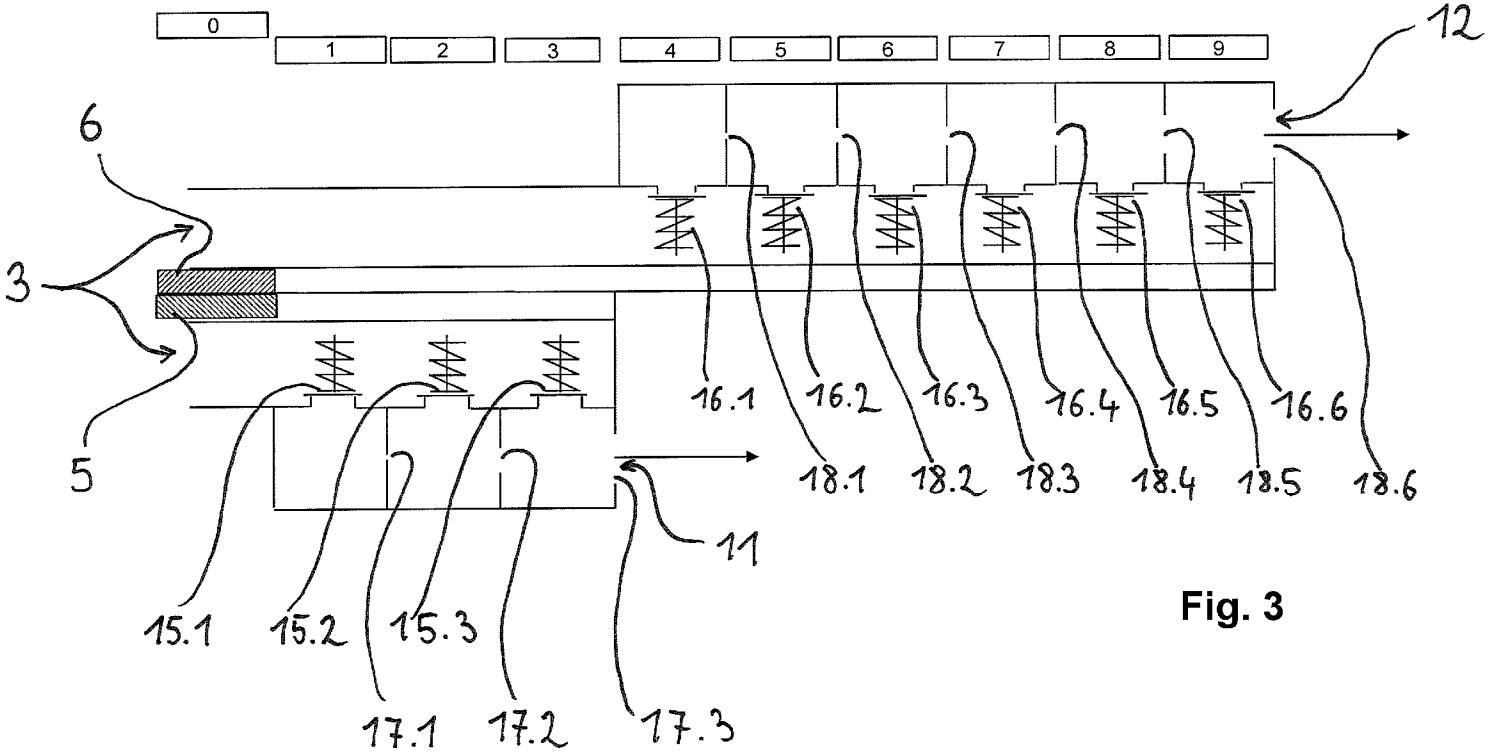
FIG. 3 shows the switch position of the closed dual circuit gas valve.

FIG. 3 shows the switch position "0" of the closed dual circuit gas valve 1. In this switch position the two magnetically acting bodies 5, 6 are located in the drawing to the left of the first on-off valves 15 and the second on-off valves 16. This position of the magnetically acting bodies 5, 6 corresponds to the switch position shown in FIG. 2. In this case all on-off valves 15, 16 are closed by means of spring force. The gas present at the gas inlet 3 can neither flow to the first gas outlet 11 nor the second gas outlet 12.

If the two magnetically acting bodies 5, 6 embodied as permanent magnets, starting from the position depicted in FIG. 3, are moved to the right in the drawing, the first on-off valve 15.1 opens first. A further movement of the magnetically acting bodies 5, 6 to the right then additionally opens the first on-off valve 15.2.

Figure 4:
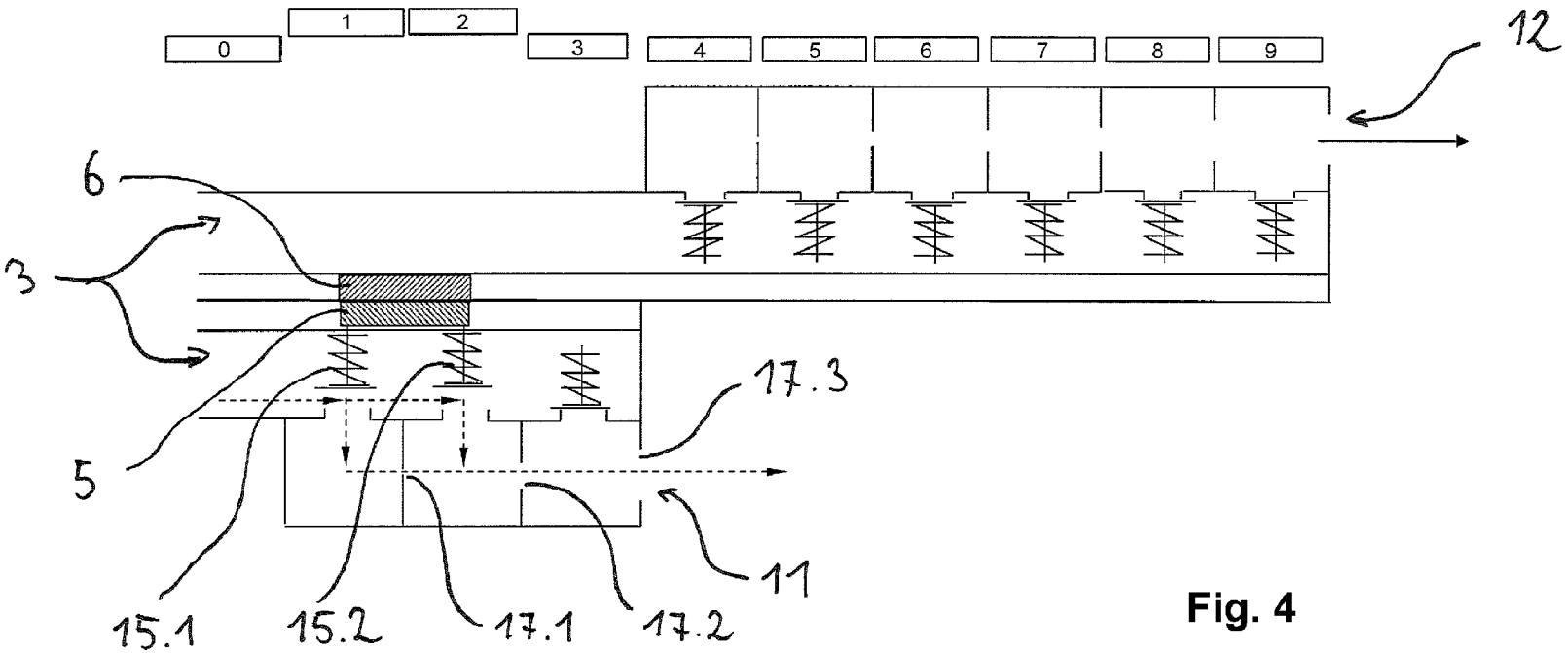
FIG. 4 shows the switch position of the dual circuit gas valve between a first and a second switch position.

This switch position is depicted in FIG. 4. Here the greatest part of the gas flow reaching the first gas outlet 11 flows through the opened on-off valve 15.2 and the throttle points 17.2 and 17.3. The gas flow coming in through the opened on-off valve 15.1 and the throttle point 17.1 is comparatively negligibly small. When the magnetically acting bodies 5, 6 are moved further to the right in the drawing, the on-off valve 15.1 closes and only the on-off valve 15.2 remains open. The gas volume flow then reaching the first gas outlet 11 in this switch position is practically identical to the gas volume flow in the switch position in accordance with FIG. 4. It is especially important for the function of the dual circuit gas valve that during the switchover from the opened on-off valve 15.1 to the opened on-off valve 15.2 in the meantime the two on-off valves 15.1 and 15.2 are opened, since this guarantees a continuous gas flow and prevents an unwanted extinction of the gas flames during the switchover process.

Figure 5:
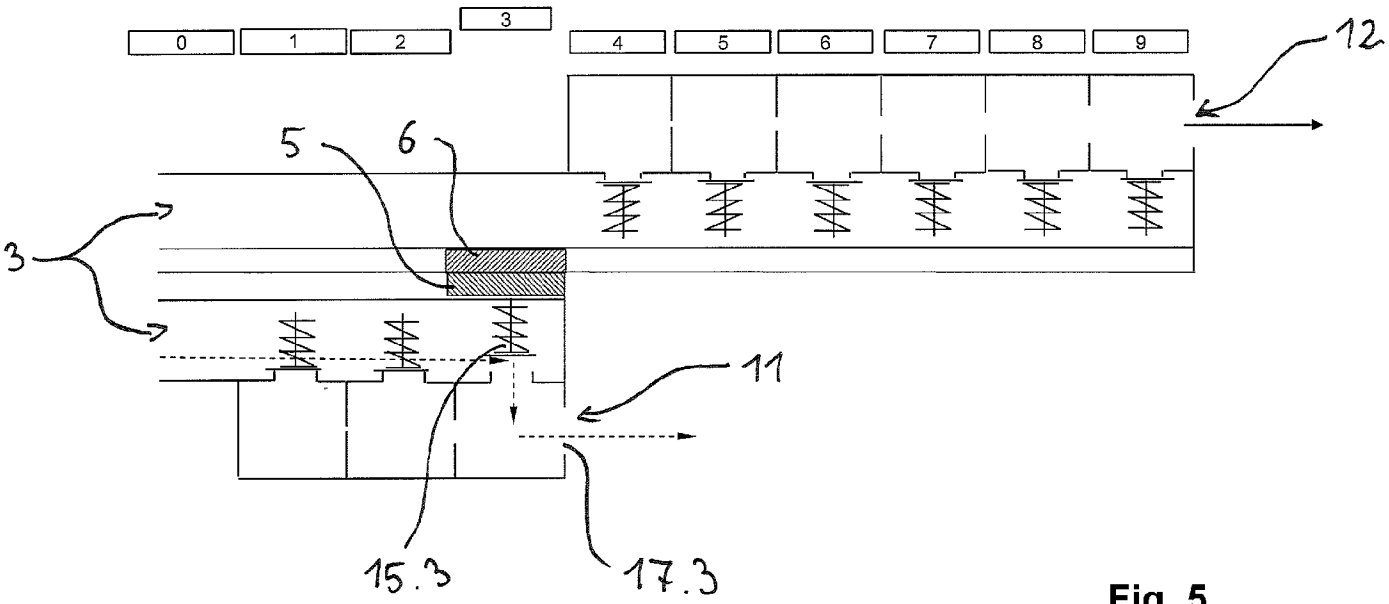
FIG. 5 shows the switch position of the dual circuit gas valve in a third switch position.

In the switch position "3" shown in FIG. 5 the magnetically acting bodies 5, 6 are in the area of the on-off valve 15.3. Here the gas volume flow to the first gas outlet 11 is at its maximum. The gas entering at gas inlet 3 flows through the opened on-off valve 15.3 directly before the throttle point 17.3 with the largest opening cross-section. The gas flow in the direction of the second gas outlet 12 is still closed in this switch position.

Figure 6:
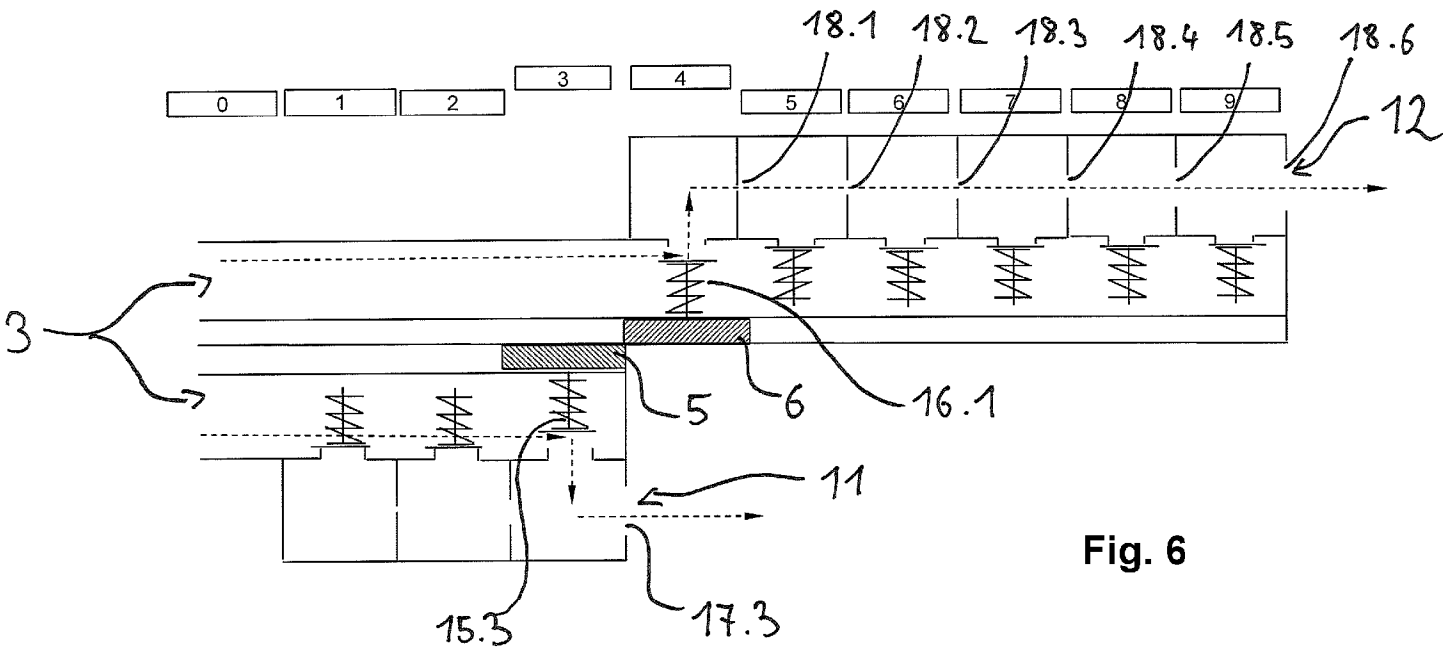
FIG. 6 shows the switch position of the dual circuit gas valve in a fourth switch position.

When the dual circuit gas valve 2 is now actuated further in the opening direction, the first magnetically acting body 5 remains in its position in accordance with FIG. 6 and only the second magnetically acting body 6 continues to move.

This switch position "4" is shown in FIG. 6. It can be seen that the flow path to the first gas outlet 11 remains open via the opened first on-off valve 15.3 and thus the flames at the inner burner 21 of the dual circuit gas burner 1 continue to burn at their maximum size. In addition to this the second on-off valve 16.1 is open, so that the gas, starting from the gas inlet 3, can flow via this opened second on-off valve 16.1 and through all second throttle points 18.1 to 18.6 to the second gas outlet 12. The flames at the outer burner 22 of the dual circuit gas burner 1 burn in this case at their minimum size, wherein the size of the gas volume flow is definitively predetermined by the cross section of the second throttle point 18.1 located on the far left of the diagram.

When the dual circuit gas valve 2 is now actuated further in the opening direction, the second on-off valves 16.2 to 16.6 open one after the other, which ensures that during each switchover process two second on-off valve 16.1 to 16.6 are always opened and at no time are all second on-off valves 16.1 to 16.6 closed. The first on-off valve 15.3 always remains open in this case.

Figure 7:
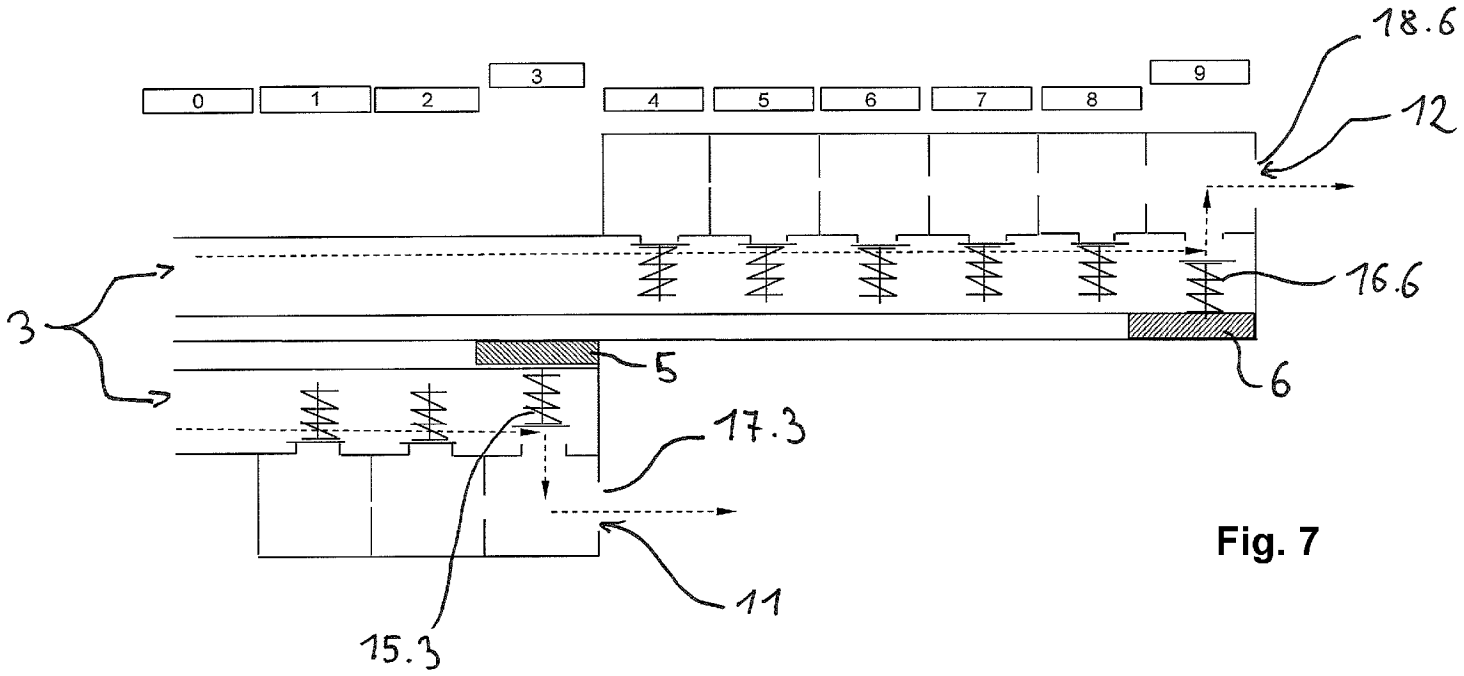
FIG. 7 shows the switch position of the dual circuit gas valve in a ninth switch position.

FIG. 7 shows the dual circuit gas valve 2 in switch position "9". Here the second magnetically acting body 6 is located at its right-hand stop in the area of the second on-off valve 16.6.

The gas flow in the direction of the second gas outlet 12 flows here directly from gas inlet 3 through the opened second on-off valve 16.6 before the second throttle point 18.6. The gas flow to the second gas outlet 12 is set by this to a maximum value. The second throttle point 18.6 is dimensioned large enough to not throttle the gas flow in practice.

For an actuation of the second gas valve 2 in the closed direction the two magnetically acting bodies 5, 6 are moved in the reverse sequence. Starting from the switch position "9", first of all only the second magnetically acting body is moved back, until all second on-off valves 16 are closed. Subsequently both magnetically acting bodies 5, 6 are moved back synchronously until all first on-off valves 15 are also closed. Lastly, when the valve is switched off, the gas flow to the second gas outlet 12 is first reduced and subsequently the gas flow to the first gas outlet 11.

The dual circuit gas valve 2 is actuated with a suitable movement device. This can for example comprise a manually actuatable rotary knob. A rotation of the rotary knob then displaces the magnetically acting bodies 5, 6 relative to the on-off valves 15, 16 in the manner described above.

As an alternative it is likewise possible to equip the movement device with a suitable actuator, for example an electric stepping motor or a combination of electric motor and transmission. This actuator can then be activated by means of a suitable electronic controller. The electronic controller then actuates the actuator automatically or in accordance with the output signal of an electronic user interface linked to the controller, which can be formed for example by touch sensors, sliders or removable magnetic knobs. A part or full automatic control of the gas valve unit can be realized by the electronic controller.

LIST OF REFERENCE CHARACTERS

1 Dual circuit gas burner
2 Dual circuit gas valve
3 Gas inlet
5 First magnetically acting body
6 Second magnetically acting body
7 Stop
8 Axis
11 First gas outlet
12 Second gas outlet
15 (15.1 to 15.3) First on-off valves
16 (16.1 to 16.6.) Second on-off valves
17 (17.1 to 17.3) First throttle points
18 (18.1 to 18.6) Second throttle points
21 Inner burner
22 Outer burner
31 First gas outlet openings
32 Second gas outlet openings

The invention claimed is:

1. A gas valve unit for adjusting a gas volume flow in a dual circuit gas burner of a gas appliance, comprising:

a valve body having a gas inlet and two gas outlets;

a control mechanism constructed to adjust the gas volumetric flow supplied to one of the gas outlets in a number of stages and to adjust the gas volumetric flow supplied to the other one of the gas outlets in a number of stages, the control mechanism including at least two first on-off valves and at least two first throttle points to adjust the gas volumetric flow supplied to the one of the gas outlets; and a first throttle path in which the first throttle points are disposed in series, and a connecting section arranged between each two adjacent first throttle points and linking one of the first on-off valves in an open state to the gas inlet, wherein the throttle points of the first throttle path—when viewed in a gas flow direction in the first throttle path—have an increasing flow cross-section.

2. The gas valve unit of claim 1, constructed for setting the gas volumetric flow to the twin-circuit gas burner of a gas cooking appliance.

3. The gas valve of claim 1, wherein the control mechanism includes second on-off valves to adjust the gas volumetric flow supplied to the other one of the gas outlets.

4. The gas valve of claim 1, wherein the control mechanism includes three of the first on-off valves and three of the first throttle points to adjust the gas volumetric flow supplied to the one of the gas outlets.

5. The gas valve unit of claim 3, wherein the control mechanism includes at least one magnetically acting body to control the first and second on-off valves, the at least one magnetically acting body being movable in relation to the first and second on-off valves.

6. The gas valve unit of claim 3, wherein the control mechanism includes at least two magnetically acting bodies, with a first one of the magnetically acting bodies being provided for control of the first on-off valves and a second one of the magnetically acting bodies being provided for control of the second on-off valves.

7. The gas valve unit of claim 5, further comprising a movement device for moving the at least one magnetically acting body in relation to the first and second on-off valves, the movement device being constructed such that, starting from a completely closed gas valve unit, upon actuation the first on-off valves assigned to the one of the gas outlets are first actuated and subsequently the second on-off valves assigned to the other one of the gas outlets are actuated.

8. The gas valve unit of claim 6, wherein, depending on a position of the first one of the magnetically acting bodies, either none of the first on-off valves is opened or precisely exactly one of the first on-off valves is opened or exactly two of the first on-off valves are opened.

9. The gas valve unit of claim 6, wherein, depending on a position of the second one of the magnetically acting bodies either none of the second on-off valves is opened or exactly one of the second on-off valves is opened or exactly two second on-off valves are opened.

10. The gas valve unit of claim 7, wherein the control mechanism includes two of the magnetically acting body, with a first one of the magnetically acting bodies being provided for control of the first on-off valves and a second one of the magnetically acting bodies being provided for control of the second on-off valves, the movement device being constructed to move the second magnetically acting body synchronously to the first magnetically acting body when the gas valve unit assumes a switch position in which at least one of the first on-off valves is opened and all second on-off valves are closed.

11. The gas valve unit of claim 7, wherein the control mechanism includes two of the magnetically acting body, with a first one of the magnetically acting bodies being provided for control of the first on-off valves and a second one of the magnetically acting bodies being provided for control of the second on-off valves, the movement device being constructed such that in a switch position of the gas valve unit in which at least one of the second on-off valves is opened, the first magnetically acting body is not moved during a movement of the second magnetically acting body.

12. The gas valve unit of claim 7, wherein the movement device is constructed such that at least one of the first on-off valves is opened at a same time as at least one of the second on-off valves is open.

13. The gas valve unit of claim 7, wherein the movement device is constructed such that exactly one of the first on-off valves is opened at a same time as at least one of the second on-off valves is open.

14. A gas valve unit for adjusting a gas volume flow in a dual circuit gas burner of a gas appliance, comprising:

a valve body having a gas inlet and two gas outlets; and a control mechanism constructed to adjust the gas volumetric flow supplied to one of the gas outlets in a number of stages and to adjust the gas volumetric flow supplied to the other one of the gas outlets in a number of stages, wherein the control mechanism includes first on-off valves to adjust the gas volumetric flow supplied to the one of the gas outlets and second on-off valves to adjust the gas volumetric flow supplied to the other one of the gas outlets, the control mechanism includes at least two magnetically acting bodies, with a first one of the magnetically acting bodies being provided for control of the first on-off valves and a second one of the magnetically acting bodies being provided for control of the second on-off valves, and each of the at least two magnetically acting bodies is a permanent magnet.

15. The gas valve of claim 14, wherein the control mechanism includes at least two of the first on-off valves and at least two first throttle points to adjust the gas volumetric flow supplied to the one of the gas outlets.

16. The gas valve of claim 15, wherein the control mechanism includes at least two of the second on-off valves and at least two second throttle points to adjust the gas volumetric flow supplied to the other one of the gas outlets.

17. The gas valve of claim 15, wherein the control mechanism includes four of the second on-off valves and four second throttle points to adjust the gas volumetric flow supplied to the other one of the gas outlets.

18. The gas valve unit of claim 15, further comprising a first throttle path in which the first throttle points are disposed in series, and a connecting section arranged between each two adjacent first throttle points and linking one of the first on-off valves in an open state to the gas inlet.

19. The gas valve unit of claim 16, further comprising a second throttle path in which the second throttle points are disposed in series, and a connecting section arranged between each two adjacent second throttle points and linking one of the second on-off valves in an open state to the gas inlet.

20. A gas valve unit for adjusting a gas volume flow in a dual circuit gas burner of a gas appliance, comprising:

a valve body having a gas inlet and two gas outlets; and a control mechanism constructed to adjust the gas volumetric flow supplied to one of the gas outlets in a number of stages and to adjust the gas volumetric flow supplied to the other one of the gas outlets in a number of stages, the control mechanism including at least two first on-off valves and at least two first throttle points to adjust the gas volumetric flow supplied to the one of the gas outlets, at least two second on-off valves and at least two second throttle points to adjust the gas volumetric flow supplied to the other one of the gas outlets, and a second throttle path in which the second throttle points are disposed in series, and a connecting section arranged between each two adjacent second throttle points and linking one of the second on-off valves in an open state to the gas inlet wherein the throttle points of the second throttle path—when viewed in a gas flow direction in the second throttle path—have an increasing flow cross-section.

* * * * *